United States Patent [19]

Stenberg

[11] Patent Number: 4,784,725

[45] Date of Patent: Nov. 15, 1988

[54] VAT PAPER MACHINE

[75] Inventor: Erik G. Stenberg, Karlstad, Sweden

[73] Assignee: Valmet Paper Machinery, Inc., Helsingfors, Finland

[21] Appl. No.: 108,148

[22] Filed: Oct. 14, 1987

[30] Foreign Application Priority Data

Oct. 20, 1986 [SE] Sweden ..... 8604447
Sep. 22, 1987 [SE] Sweden ..... 8703656

[51] Int. Cl.[4] ..... D21F 1/60; D21F 1/00; D21F 1/10

[52] U.S. Cl. ..... 162/317; 162/319; 162/321; 162/334; 162/323; 162/351; 162/354

[58] Field of Search ..... 162/318, 317, 319, 320, 162/323, 321, 351, 334, 354

[56] References Cited

U.S. PATENT DOCUMENTS

| | | | |
|---|---|---|---|
| 2,929,448 | 3/1960 | Shoumatoff | 162/313 |
| 2,974,726 | 3/1961 | Okawa et al. | 162/328 |
| 4,659,432 | 4/1987 | Stenberg | 162/318 |

FOREIGN PATENT DOCUMENTS

| | | |
|---|---|---|
| 1072877 | 1/1960 | Fed. Rep. of Germany . |
| 109941 | 2/1944 | Sweden . |

*Primary Examiner*—David L. Lacey
*Assistant Examiner*—Thi Dang
*Attorney, Agent, or Firm*—Bell, Seltzer, Park & Gibson

[57] ABSTRACT

A vat paper machine is disclosed, the machine including a cylinder-vat unit having a rotatable cylinder mold, a vat and a headbox for providing a continuous supply of stock to the vat. The vat has a special wall structure and is arranged upstream of the cylinder mold in such a manner that the wire gauze covered cylinder mold is brought into contact with stock in the vat to form a web by draining water from the stock through the wire gauze covered surface of the mold. An outer wire is also provided which runs in a loop over a breast roll, through the vat at the wall structure thereof and then over and around a portion of the circumference of the cylinder mold. The wall structure comprises an endless liquid-impervious belt forming an endless loop located on the inner side of the loop defined by the outer wire. The belt and the outer wire run together in close surface contact with each other at least within the area between the breast roll and the cylinder mold, whereby the liquid-impervious belt forms a liquid barrier for the stock in the vat.

20 Claims, 6 Drawing Sheets

VAT PAPER MACHINE

FIELD AND BACKGROUND OF THE INVENTION

The present invention relates to a vat paper machine which comprises a cylinder-vat unit having a rotatable cylinder mold, a vat and a headbox connected to the vat for providing a continuous supply of stock to a predetermined level in the vat.

A vat paper machine with a vat section is know through U.S. Pat. No. 4,659,432. The vat section is provided with a platform between the breast roll and the cylinder mold, said platform supporting the outer wire and being provided with slit means to form one or more drainage passages to produce a second web on the outer wire by draining water from the stock through one or more of said drainage passages. The first and second webs are then couched together to form a unitary web which is removed from the cylinder mold. The part of the vat bottom located nearest the nip between outer wire and cylinder mold is provided with a sealing lip arranged to press the outer wire against the cylinder mold. Particularly when it is desired to run this vat paper machine with fully closed platform with the intention to produce a web consisting of a single layer which is then formed on the cylinder mold, it has proved difficult to achieve a perfect seal at the bottom of the vat in the vicinity of said nip so that fibres may be deposited on the outer wire before it joins the web formed on the cylinder mold. The undesired layer of fibres is deposited unevenly on the outer wire so that a paper is produced having a correspondingly uneven grammage. Furthermore, irregular flows may occur in the stock before the nip, due to said undesired drainage through the outer wire in the vicinity of the nip. These flows have an unfavourable influence on the forming of the web on the cylinder mold, in that portions of the web are washed away so that the fibre distribution and grammage of the web becomes uneven. These problems are particularly serious in the manufacture of security paper with water marks, where the wire gauze on the cylinder molds has sections designed therein giving deviating paper thickness. Said sections have recesses which form openings between the outer wire and the cylinder mold, through which the stock can be pressed out so that fibres are deposited on the outer wire. Said openings cannot be closed by said sealing lip since this is permitted only to be pressed against the cylinder mold with a limited pressure so as not to destroy the raised portions of said sections which are to produce the water marks.

SE No. 109 941 describes an apparatus for dewatering a fibre suspension between a rotating screen cylinder and an endless belt of water-impervious material such as rubber. Similar apparatus are described in DE No. 1 072 877 and U.S. Pat No. 2,929,448. U.S. Pat No. 2,974,726 relates to a cylinder-vat unit equipped with an endless liquid-impervious the circumference of the cylinder mold. However, these known apparatus are completely different from the vat paper machine according to the present invention. Said belts are utilized for completely different purposes and none of the specifications either suggests or intimates that they might be suitable for solving the specific problem encountered in the vat paper machine defined in the introduction.

SUMMARY OF THE INVENTION

The object of the present invention is to provide a vat paper machine of the type defined in the introduction, which eliminates each not negligible and not desired drainage through the outer wire, so that each not negligible fibre deposit on the outer wire is prevented. Accordingly, the present invention resides in an improved vat paper machine having a cylinder-vat unit including a rotatable cylinder mold, a vat and a headbox connected to the vat for providing a continuous supply of stock to a predetermined level in the vat. The vat is arranged upstream of the cylinder mold in such a manner that a moving part of the liquid-pervious outer surface of the wire gauze covered cylinder mold is brought into contact with stock in the vat to form a web by draining water from the stock through said outer surface, while an outer wire runs in a loop over a breast roll, through the vat and then over and around a portion of the circumference of the cylinder mold. A wall means is arranged at the vat between the breast roll and the cylinder mold along which the outer wire extends. The wall means comprises an endless liquid-impervious belt forming an endless loop located on the inner side of the loop defined by the outer wire. The liquid-impervious belt and the outer wire run together in close surface contact with each other at least within the area between the breast roll and the cylinder mold, whereby the liquid-impervious belt forms a liquid barrier for the stock in the vat. The present invention, therefore, overcomes the shortcomings associated with prior vat paper machines including the elimination of adverse drainage through the outer wire.

In the present context, the expression "water-impervious belt" is considered to include a belt with highly limited and thus negligible perviousness to liquid.

According to a preferred embodiment of the invention, the endless, liquid-impervious belt also surrounds a portion of the circumference of the cylinder mold, so that the liquid-impervious belt forms a liquid barrier for the liquid in the web being formed as well as a pressing means to remove liquid from the web through the outer surface of the cylinder mold.

BRIEF DESCRIPTION OF THE DRAWINGS

The invention will be described further in the detailed descriptions which follows, with reference to the accompanying drawings, in which—

DESCRIPTION OF ILLUSTRATED EMBODIMENT

Figure 1:
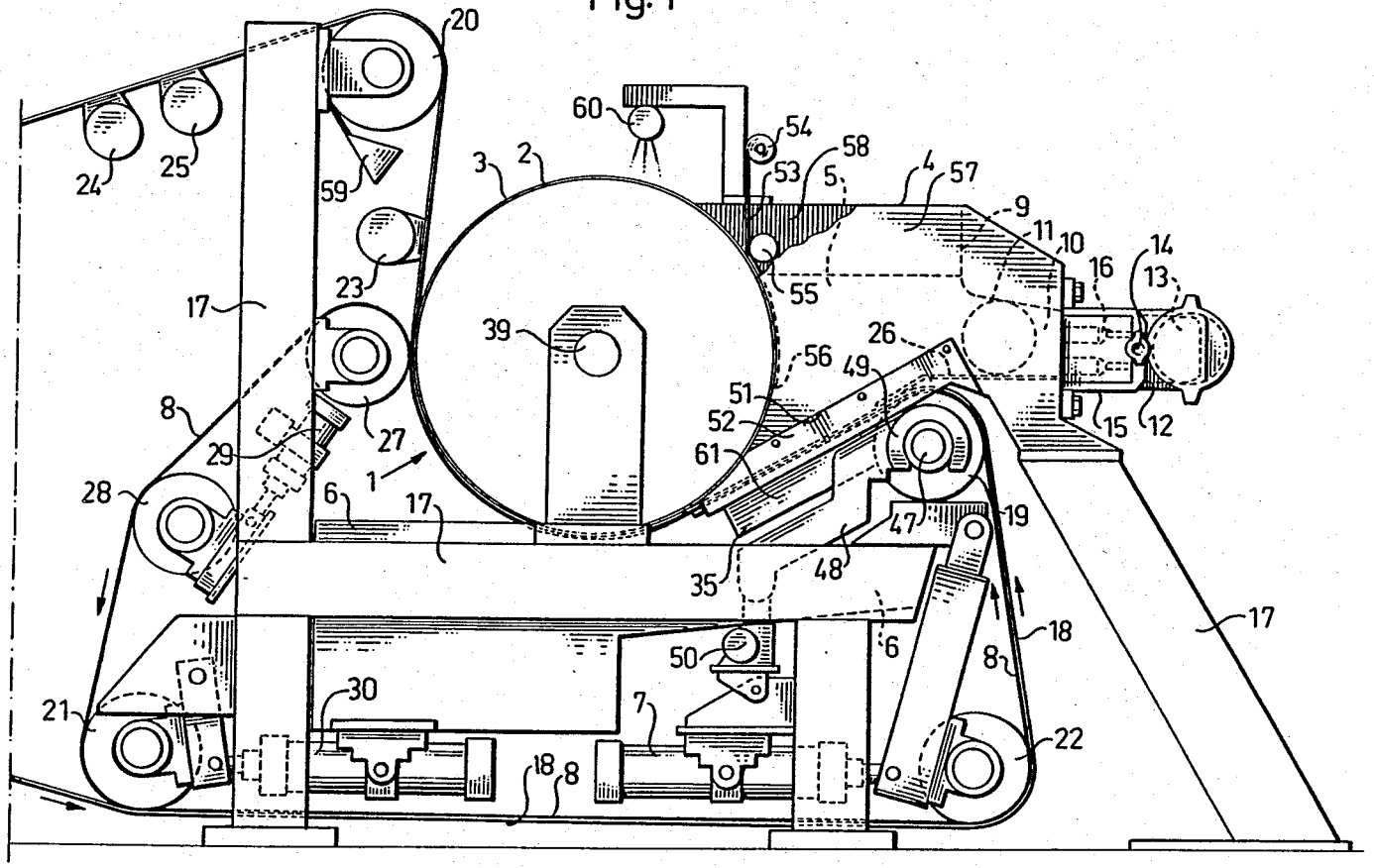
FIG. 1 shows the vat section of a vat paper machine according to a first embodiment of the invention, said vat section comprising a liquid-impervious belt running in a loop.
Figure 2:
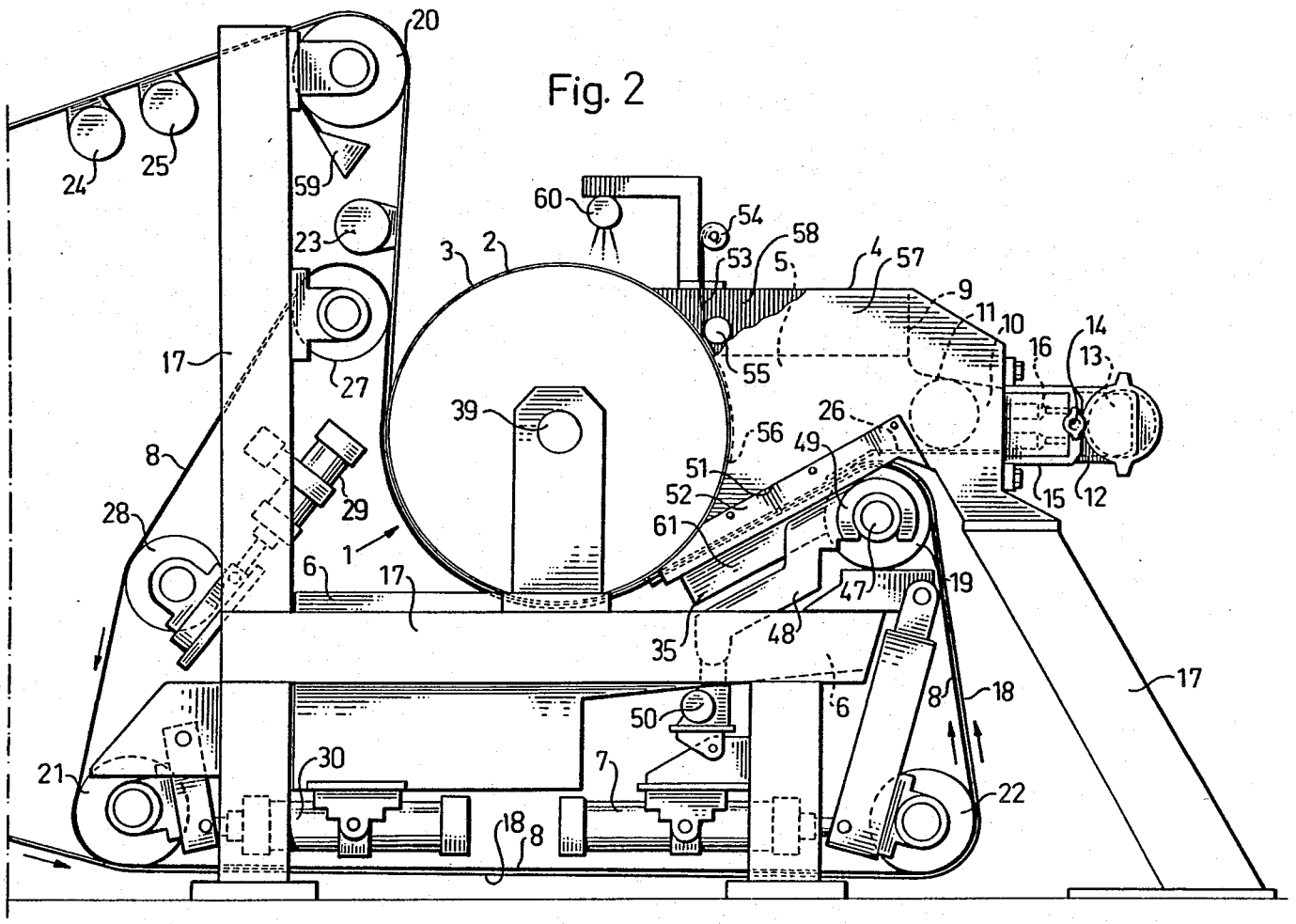
FIG. 2 shows the vat section of a vat paper machine according to a second embodiment of the invention, said vat section comprising a liquid-impervious belt running in a loop.

With reference to FIGS. 1 and 2 it is shown therein in each case a vat section of a vat paper machine comprising a cylinder-vat unit 1 with a rotatable cylinder mold 2. The cylinder mold consists of a drum open at its opposite ends with one or more endless wire gauzes 3 arranged around it to provide a wire gauze covered surface. The cylinder-vat unit 1 also includes a vat 4 in which the cylinder mold 2 operates to produce a web by continuous dewatering of the stock 5 contained in the vat 4, the water running into the drum and out through its opposite ends being collected in a container 6 located below the cylinder mold 2. The cylinder mold 2 is kept clean by jets of water from a spray pipe 60. As is clear from FIGS. 1 and 2, the vat 4 is located on one side of the cylinder mold 2 with respect to its vertical central plane and is defined vertically by the cylinder mold 2, two side walls 57, 58 spaced from and parallel to each other and a back-piece 9 with an inlet 10 in which a horizontal perforated roll 11 is preferably arranged to rotate. A headbox 12 is connected to the inlet 10 to supply stock into the vat 4 in such a way that a desired level of stock 5 is maintained in the vat 4.

The headbox 12 preferably has a horizontal, tapering inlet chamber 13 with a stock inlet (not shown) and a secondary outlet 14 arranged at the opposite side of the headbox 12 for excess stock, which is returned to the stock supply. The headbox 12 has a horizontal oblong outlet 15 extending transversely and communicating with the inlet 10 of the vat 4 and includes a stationary hole plate 16 to ensure uniform distribution of the stock along the entire length of the outlet 15.

The above-mentioned members in the form of the cylinder mold 2, vat 4 and headbox 12 are supported by a stand 17 in the vat paper machine.

The vat paper machine also comprises an outer wire 18, driven in the direction indicated by an arrow and, in the shown embodiments, arranged to surround a portion of the circumference of the cylinder mold 2, the outer wire 18 being preferably arranged to run in a loop over a plurality of rolls including a breast roll 19, a guide roll 20 located above the cylinder mold 2 and first and second stretch rolls 21, 22 spaced from each other and located below the cylinder mold 2. The stretch rolls 21, 22 preferably are displaceable and adjustable by means of movement-transmitting means 7, 30 which may take the form of hydraulic or pneumatic cylinders. The second stretch roll 22 is arranged, with the aid of the movement-transmitting means 7, to set the desired tension in the outer wire 18. Immediately after the cylinder mold 2 there is a suction box 23, which is mounted in contact with the outer wire 18 inside its loop. The suction box 23 is arranged to increase the dry solids content of the web after its transfer from the cylinder mold 2. Two similar suction boxes 24, 25 are mounted after the guide roll 20 to remove additional water from the web. The guide roll 20 is provided with a doctor blade 59. Similar wiping means may also be mounted in association with other rolls, e.g. at the breast roll 19.

As will be clear from FIGS. 1 and 2, the outer wire 18 runs through the vat 4 in direct contact with the stock 5. The vat is provided with a wall means, in these embodiments constituting a bottom-wall means, which comprises an apron 26 arranged to extend from the outlet 15 of the headbox 12 up to and a sufficient way past the breast roll 19 to form a sealing bridge for the stock flow in connection with the outer wire 18.

According to the present invention said bottom-wall means of the vat 4 also comprises an endless, liquid-impervious belt 8 arranged to run in a loop located inside the loop described by the outer wire 18, the liquid-impervious belt 8 being in close surface contact with the outer wire 18 at least within the area situated between the breast roll 19 and the cylinder mold 2. In the embodiments shown the liquid-impervious section 8 is arranged to also surround a portion of the circumference of the cylinder mold 2 and run in said loop over a plurality of rolls. Counted from the cylinder mold 2, these rolls include a guide roll 27, an alignment roll 28, said first stretch roll 21, said second stretch roll 22 and said breast roll 19. The liquid-impervious belt thus meets the outer wire 18 at the first stretch roll 21 and then runs on the inside of and at the same speed as the outer wire 18, around the second stretch roll 22 and breast roll 19. It passes then through the vat 4 with the outer wire 18 above and in close surface contact with the liquid-impervious belt 8, under the action of the weight of the stock 5. As mentioned above, the liquid-impervious belt 8 then runs around a portion of the circumference of the cylinder mold 2, leaving this cylinder and the outer wire 18 on the side of the cylinder mold 2 facing away from the vat 4, to continue around the guide roll 27, over the alignment roll 28 and back down to the first stretch roll 21 and the outer wire 18. The first stretch roll 21 is arranged, with the aid of the movement-transmitting means 30, to set the desired tension in the liquid-impervious belt 8. The alignment roll 28 can be displaced in either direction along the liquid-impervious belt 8 by means of a movement-transmitting means 29 which may take the form of a hydraulic or pneumatic cylinder.

In the embodiment shown in FIG. 1 the guide roll 27 is arranged at substantially the same level as the axis of rotation 39 of the cylinder mold 2. In the embodiment shown in FIG. 2, however, the guide roll 27 is located at a higher level, i.e. at a level which is higher than the axis of rotation 39 of the cylinder mold 2 and also spaced from the outer surface of the cylinder mold 2. In both cases the liquid-impervious belt 8 leaves the outer wire at the guide roll 27, as shown in FIGS. 1 and 2, or slightly before the guide roll (not shown). In the latter case the guide roll is spaced slightly from the outer wire.

Figure 3:
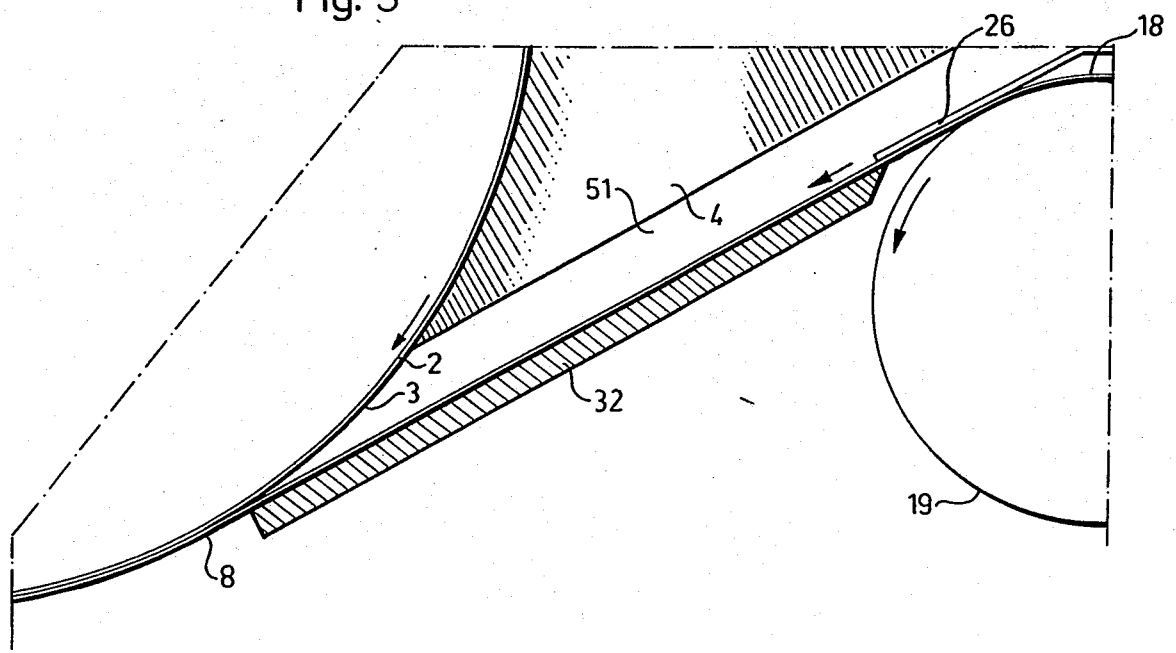
FIG. 3 shows the lower portion of the vat according to FIG. 1, somewhat enlarged, in which the bottom wall means of the vat comprises a support means in the form of a flat plate.
Figure 4:
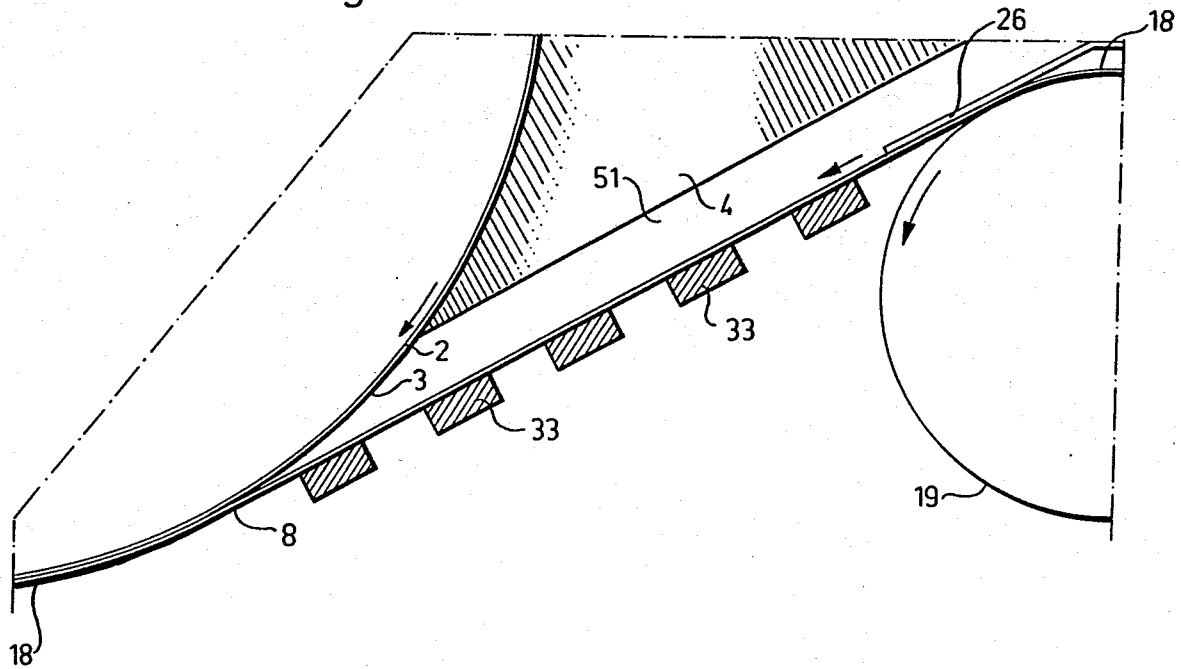
FIG. 4 shows an alternative support means in the form of a plurality of parallel rods.
Figure 5:
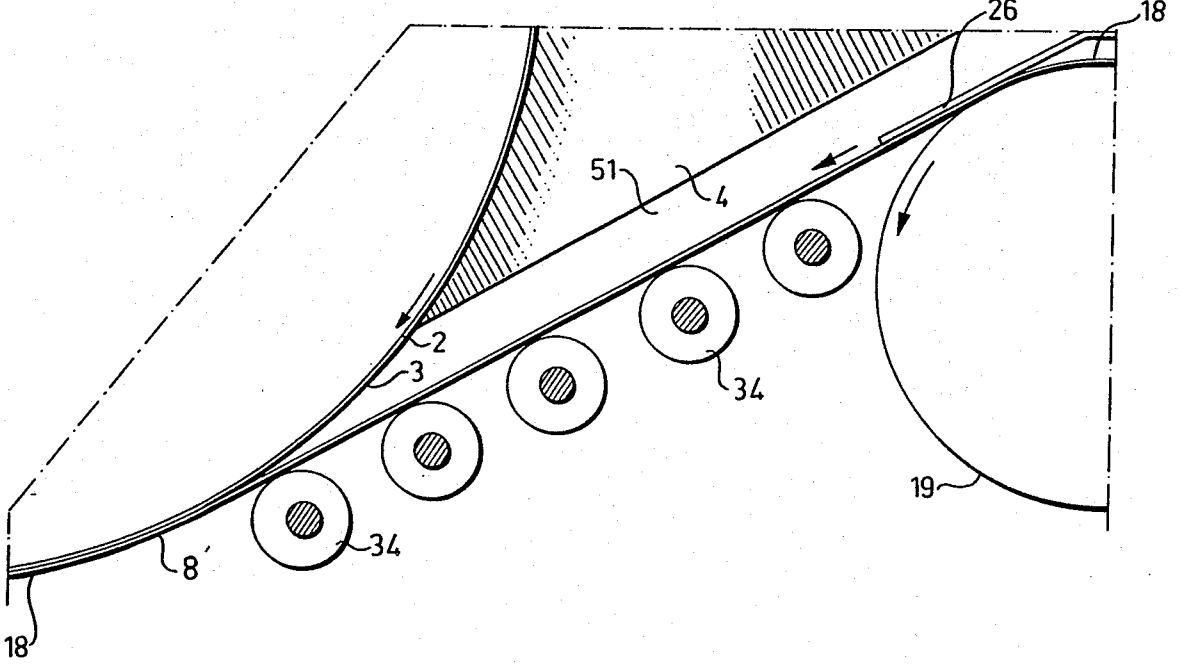
FIG. 5 shows an alternative support means in the form of a plurality of parallel rollers.

Particularly when the breast roll 19 is located at a greater distance from the cylinder mold 2, the supporting ability of the liquid-impervious belt 8 may be insufficient to support the outer wire 18 and the stock 5 contained in the vat 4. FIGS. 3, 4 and 5 show suitable support means which may be arranged below the liquid-impervious belt 8 in the area between the cylinder mold 2 and the breast roll 19. The support means in FIG. 3 consists of a flat, bend resistant plate 32, whereas that in FIG. 4 consists of a plurality of parallel ribs 33, suitably spaced from each other and located parallel to the axis of rotation 39 of the cylinder mold. The liquid-impervious belt 8 moves over said plate 32 and ribs 33, respectively, in sliding contact therewith. FIG. 5 shows a support means which consists of a plurality of parallel rotatable rollers 34, suitably spaced from each other and arranged parallel to the axis of rotation 39 of the cylinder mold 2, the liquid-impervious belt 8 moving over the rollers 34 with minimum friction therebetween.

In the embodiment shown in FIG. 1, as also in that of FIG. 2, the support means, i.e. the plate 32 is mounted in a stand 35 pivotably arranged about the axis of rotation 47 of the breast roll 19. The stand 35 has opposite side-pieces 61 carried by two support arms 48 having upper bearing means 49 arranged on a shaft including the axis of rotation 47 of the breast roll 19. The support arms 48 are connected at their lower ends to an adjusting means in the form of a screw jack 50 mounted on the stand 17 of the vat paper machine. By means of this screw jack 50, the support arms 48, and thus the entire stand 35 with support means, can be pivoted about the axis of rotation 47 of the breast roll 19. The invention is thus also applicable to a cylinder-vat unit 1 which has exchangeable cylinder molds 2 having different diameters or which has a cylinder mold the drum of which is sectioned enabling its diameter to be altered to give a larger or smaller outer surface as desired, and in relation to the dimensions of the cylinder-vat unit. By lowering or raising the movable end of the stand 35 facing away from the breast roll 19, by means of the screw jack 50, the support means, e.g. the plate 32, can be positioned for different diameters of the cylinder mold in supporting cooperation with the liquid-impervious belt 8 and outer wire 18.

The front side wall 57 of the vat 4 may be provided with an opening 51 which can be closed by a cover 52. This opening makes the support means 32 easily accessible for replacement or adjustment if necessary.

When the guide roll 27 is arranged in the manner shown in FIG. 1 in order to exert preferably a light pressure onto the cylinder mold, it has suitably a soft outer surface of rubber, for instance. The guide roll 27 can then advantageously be utilized to assist in dewatering the web before it leaves the cylinder mold 2. In the embodiment shown in FIG. 2, however, the guide roll 27 has a hard outer surface consisting of steel, for instance.

The length of the forming zone of the cylinder mold 2 is usually determined by the level of the stock in the vat 4. As will be clear from FIGS. 1 and 2, however, the length of the forming zone can be adjusted as desired by means of a water-impervious shielding means in the form of a curtain 53 of suitable material, which is unrolled from a reel 54 and guided towards the cylinder mold 2 by means of a support roll 55. The lower, free edge 56 of the curtain defines the start line of the forming zone, which is thus adjustable. Alternatively the curtain may consist of several parts, it being slit into sections, for instance.

If desired, a supply of a continuous security thread is arranged in connection to the vat, and fed to the cylinder mold to be embedded in the web being formed.

Figure 6:
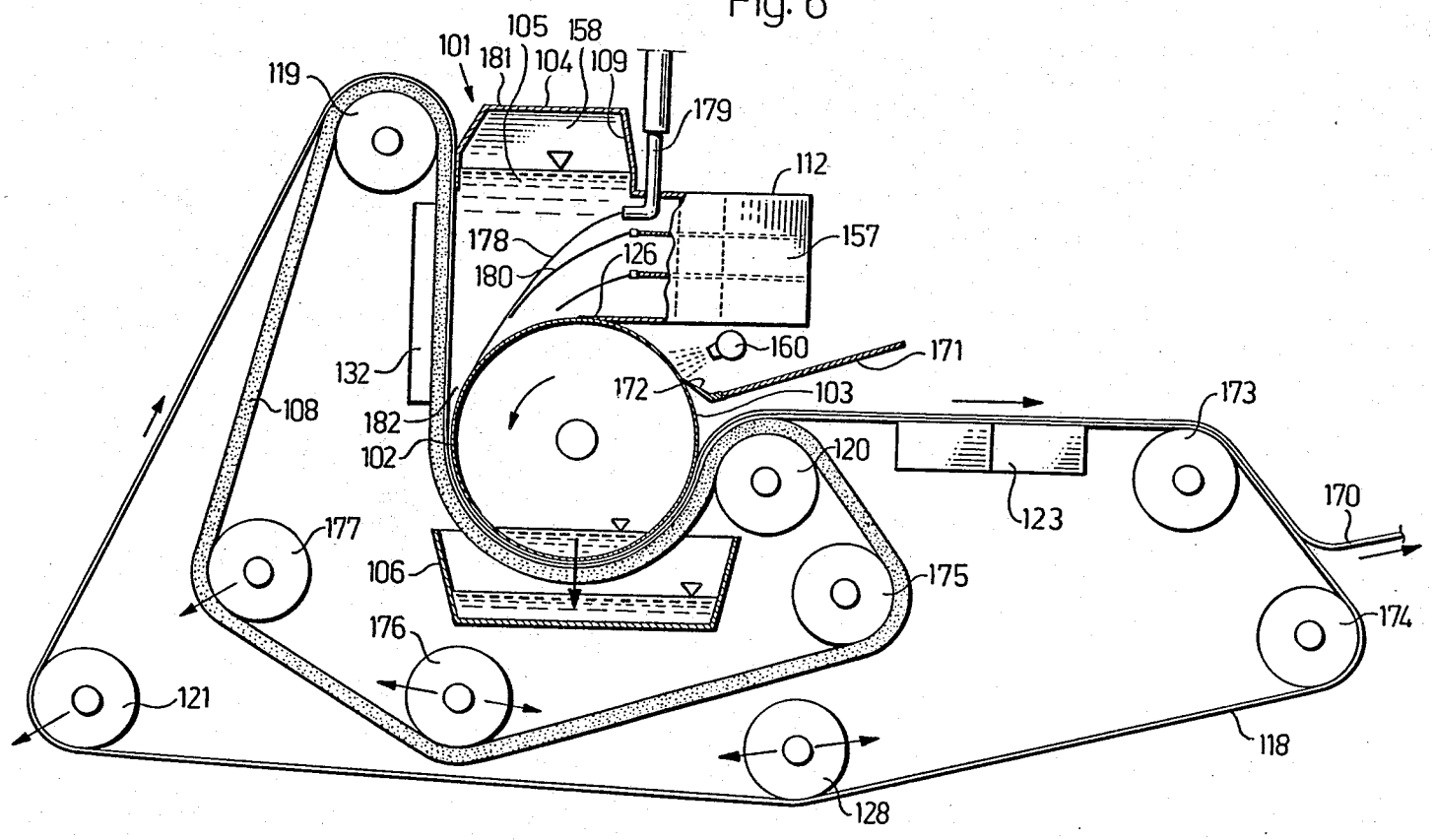
FIG. 6 shows the vat section of a vat paper machine according to a third embodiment of the invention, said vat section comprising a liquid-impervious belt running in a loop.

With reference to FIG. 6 it is shown therein more schematically the vat section of a vat paper machine according to a third embodiment of the invention. The vat section comprises a cylinder-vat unit 101 with a rotatable cylinder mold 102 comprising a drum with one or more endless wire gauzes 103 arranged around it to provide a wire gauze covered surface. The cylinder-vat unit 101 also includes a vat 104 in which the cylinder mold 102 operates to produce a web 170 by continuous dewatering of the stock 105 contained in the vat 104. The water runs into the drum and out through its open opposite ends being collected in a container 106 located below the cylinder mold 102. The cylinder mold 102 is kept clean by jets of water from a spray pipe 160, and a protective plate 171 is arranged below the spray pipe 160 to prevent splashing onto the web 170. The protective plate 171 is provided with a rubber lip 172 which trails against the cylinder mold 102.

Unlike the two embodiments described earlier, the vat 104 in the embodiment shown in FIG. 6 is located straight above the cylinder mold 102 and entirely above the horizontal central plane of the cylinder mold. The vat is defined vertically by a wall means (which might be designated as a side-wall means having the same function as the bottom-wall means in the embodiments described earlier), two parallel side-plates 157, 158 spaced from each other, and a back-piece 109 spaced from said side-wall means as well as a headbox 112 mounted below the back-piece 109, for the supply of stock into the vat 104 in such a way that the stock 105 is maintained at a desired level in the vat 104. The bottom of the vat is formed by the cylinder mold 2 and an apron 126 which is secured to the lower edge of the headbox 112 and extends to and sufficiently far over the cylinder mold 2 to form a sealing bridge for the stock flow in connection to the cylinder mold 102.

The above-mentioned parts in the form of the cylinder mold 102, vat 104 and headbox 112 are supported by a stand (not shown) in the vat machine.

The vat paper machine also includes an outer wire 118, driven in the direction indicated by an arrow and, in the embodiment shown, arranged to surround a portion of the circumference of the cylinder mold 102, the outer wire 118 being preferably arranged to run in a loop over a plurality of rolls including a breast roll 119 mounted adjacent to the upper portion of the vat 104, a guide roll 120 located after and adjacent to the cylinder mold 102, two suitably spaced guide rolls 173, 174, an alignment roll 128 mounted below the cylinder mold 102 and a stretch roll 121. The two last-mentioned rolls are displaceable and adjustable in the directions indicated by arrows, by means of movement-transmitting means which may take the form of hydraulic or pneumatic cylinders. Immediately after the guide roll 120 at the cylinder mold there are suction boxes 123 mounted in contact with the outer wire 118 inside its loop. These suction boxes 123 are arranged to increase the dry solids content of the web 170 after its transfer from the cylinder mold 102. Suitable wiping means may be mounted in association with one or more rolls.

According to the present invention said side-wall means of the vat 104 comprise an endless, liquid-impervious belt 108 arranged to run in a loop located inside the loop described by the outer wire 118, the liquid-impervious belt 108 being in close surface contact with the outer wire 118 at least within the area situated between the breast roll 119 and the cylinder mold 102. In the embodiment shown, the liquid-impervious section 108 is arranged to also surround a portion of the circumference of the cylinder mold 102 and run in said loop over a plurality of rolls. Counted from the cylinder mold 102, these rolls include said first guide roll 120, a second guide roll 175, an alignment roll 176, a stretch roll 177 and said breast roll 119. The liquid-impervious belt 108 thus meets the outer wire 118 at the breast roll 119 and then runs on the inside of and at the same speed as the outer wire 118, around a portion of the circumference of the cylinder mold 102 and guide roll 120. The liquid-impervious belt 108 passes through the vat 104, with the outer wire 118 inside the liquid-impervious belt and in close surface contact therewith, under the action of the pressure from the stock 105. The stretch roll 177 is arranged, with the aid of a suitable movement-transmitting means, not shown, to set the desired tension in the liquid-impervious belt 108. The alignment roll 176 can be displaced in either direction along the liquid-impervious belt 108 by means of a suitable movement-transmitting means, not shown. In the embodiment shown in FIG. 6 the liquid-impervious belt 108 extends vertically between the breast roll 119 and cylinder mold 102 so that the entire vat 104, i.e. including also the part 182 located at the nip, is arranged above the horizontal central plane of the cylinder mold. Alternatively, this extension may have a slight inclination to the left or right, as seen in FIG. 6. In the first case the nip part 182 will then be located below said horizontal central plane and the forming zone will be correspondingly increased, whereas in the second case it will be located above the central plane with a corresponding decrease in the forming zone.

A suitable support means is arranged close to the liquid-impervious belt 108 in the area between the cylinder mold 102 and the breast roll 119 in order to take up the pressure from the stock 105. The liquid-impervious belt 108 is in sliding contact with the support means. In the embodiment shown in FIG. 6 the support means consists of a flat, bend resistant plate 132, but in other embodiments it may consist of a plurality of parallel ribs or rotatable rollers spaced from each other, on which the liquid-impervious belt 108 moves with minimum friction therebetween.

In the embodiment shown in FIG. 6 a supply of a continuous security thread 178 is arranged in connection to the vat 104 and fed down to the cylinder mold 102 to be embedded in the web 170 being formed. The thread 178 is passed through a vertical pipe 179 extending through the headbox 112 and terminating in a pipe bend opening into the vat 104. The pipe 179 is preferably vertically movable to allow adjustment of the security thread 178 in the correct position. The pipe 179 may also be pivotable about its central axis to allow the pipe bend to be pivoted laterally, allowing the position of the security thread 178 across the web 170 to be altered when so desired.

The headbox 112 is so arranged in relation to the cylinder mold 102 that it supplies stock substantially tangentially out onto the wire 103 of the cylinder mold and in the same direction as the direction of movement of the cylinder mold 102 at the forming zone. This arrangement is advantageous since the flow or flows of stock (if a multi-layered headbox is used) will reach the forming zone by the shortest route without first flowing into other parts of the vat and causing undesired turbulence. In the embodiment shown in FIG. 6 the headbox is provided with three separate stock channels so that three stock flows are supplied in the direction to the forming zone of the cylinder mold. The stock flows are kept separated before the forming zone by suitable foils 180 secured to the front portions of the headbox 112. The pipe 179 for the security thread may alternatively extend further down into the headbox, e.g. to the middle stock channel. In the embodiment shown in FIG. 6 the vat is provided at the top with a roof element 181 so that it is entirely sealed. Thereby it is possible to maintain a slight pressure above atmospheric in the space above the surface of the stock in the vat 104 so that an increased drainage of water through the cylinder mold 102 is obtained. The speed of the cylinder mold can then be increased so that a corresponding increase in the capacity of the vat paper machine is attained. A further advantage gained with a closed vat in combination with a multilayer headbox is that the level of stock in the vat 104 can be controlled by means of the air pressure in the vat. The set point of the total pressure in the middle channel of the head box gives all mixing pumps a basic rotation speed (three mixing pumps, not shown, are used in the embodiment of the invention illustrated in FIG. 6). Furthermore, the pumps for the outer channels (the lower and upper stock channels) are given a positive or negative rotation speed supplement in relation to the set point for the stock flows, measured by flow gauges.

When the vat is located at the side of the vertical central plane of the cylinder mold, as shown in FIGS. 1 and 2, irregular flows will occur in the stock in the vicinity of the cylinder mold at the point where the cylinder mold first runs into the space filled with stock. These irregular flows might cause uneven fibre distribution on the cylinder mold if all available forming zone were to be utilized. Said curtain 53 therefore shields a portion of the cylinder mold 2 from such irregular flows in the stock. However, this results in a reduced capacity. Since the level of the stock is below the highest point of the cylinder mold it is impossible to apply pressure above atmospheric on the stock to obtain increased capacity. The embodiment according to FIG. 6 is an improvement in this respect in that it utilizes the advantages of a liquid-impervious belt while at the same time the capacity can be increased since the entire available surface of the cylinder mold passing through the vat can be utilized to drain water from the stock and a pressure above atmospheric can be applied on the stock surface in the vat as mentioned above. This is possible since the vat 104 according to FIG. 6 is arranged vertically above the cylinder mold 102 so that the stock surface is situated above and spaced from the upper limit of the cylinder mold instead of below it as in FIGS. 1 and 2.

The cylinder-vat units shown and described above with an outer wire, are particularly suitable for the manufacture of security paper having true watermarks. Such security paper can then be manufactured with the desired formation and desired uniform grammage.

Since the belt 8; 108 according to the invention is liquid-impervious and is in close surface contact with the outer wire 18; 118 at the vat 4; 104, it functions during its passage through the vat 4; 104 as an effective liquid barrier, therebY preventing liquid from passing through the outer wire 18; 118. This would otherwise cause an undesired deposit of fibres onto the outer wire.

The liquid-sealing function of the liquid-impervious belt 8; 108 is also utilized advantageously when the liquid-impervious belt runs around the cylinder mold 2; 102 in that liquid is prevented from being pressed out radially from the cylinder mold 2; 102. Instead, the liquid-impervious belt 8; 108 functions as an extra pressure means so that the liquid content in the web can be reduced in an advantageous manner.

The endless liquid-impervious belt 8; 108 may consist of a suitable material such as plastic or rubber material. It may also consist of a wire the openings of which being filled with plastic material, forming a sealed wire. It is even possible to start with a liquid-pervious textile felt which, after a short time in operation, becomes clogged by fibres from the stock, thus producing a liquid-impervious belt. The expression "liquid-impervious belt" is therefore also to be referred to the conditions prevailing during normal operation.

That which is claimed is:

1. A vat paper machine comprising a vat having means forming a wall of said vat, a headbox connected to the vat for providing a continuous supply of stock to a predetermined level in the vat, a rotatabe cylinder mold having a wire gauze covered outer surface, said cylinder mold being so positioned relative to the vat that upon rotation of the cylinder mold, the wire gauze covered surface will be brought into contact with the stock in the vat to form a web thereon by draining water from the stock through said wire gauge covered surface, an outer wire forming an endless loop in said vat paper machine, a breast roll located adjacent said means defining a wall of the vat and supporting said outer wire so as to extend along a path of travel from the breast roll through the vat along said wall defining means and then over and around a portion of the circumference of said cylinder mold, and said wall defining means comprising an endless liquid-impervious belt forming an endless loop located on the inner side of the loop defined by said outer wire, said liquid-impervious belt and outer wire arranged so as to run together in close surface contact with each other at least within the area between the breast roll and the cylinder mold, whereby the liquid-impervious belt forms a liquid barrier for the stock in the vat.

2. A machine according to claim 1 wherein said endless, liquid-impervious belt also surrounds a portion of the circumference of the cylinder mold, so that the liquid-impervious belt forms a liquid barrier for the liquid in the web being formed as well as a pressing means to remove liquid from the web through the outer surface of the cylinder mold.

3. A machine according to claim 2 wherein the vat is arranged at one side of the cylinder mold with respect to the vertical central plane of the cylinder mold so that the surface of the stock in the vat will be located below the upper level of the cylinder mold.

4. A machine according to claim 3 wherein said endless, liquid-impervious belt runs around a guide roll arranged on the side of the cylinder mold facing away from the vat, whereby the liquid-impervious belt leaves the outer wire at or a short distance before said guide roll.

5. A machine according to claim 4 wherein said guide roll is arranged to exert a predetermined pressure onto the cylinder mold in order to remove liquid from the web.

6. A machine according to claim 5 wherein the guide roll is arranged at substantially the same level as the axis of rotation of the cylinder mold.

7. A machine according to claim 4 wherein said guide roll is located at a level which is higher than the axis of rotation of the cylinder mold and spaced from the outer surface of the cylinder mold.

8. A machine according to claim 3 further including curtain means to adjust the starting line for the forming zone on the cylinder mold.

9. A machine according to claim 2 wherein said wall defining means further includes a support means mounted close to said liquid-impervious belt within said area between the breast roll and the cylinder mold which provides an outer support to the liquid-impervious belt.

10. A machine according to claim 9 wherein said support means comprises a flat, bend resistant plate along which said liquid-impervious belt moves in sliding contact therewith.

11. A machine according to claim 9 wherein said support means comprises a plurality of straight, rigid ribs spaced from each other and arranged parallel to the axis of rotation of the cylinder mold, said liquid-impervious belt moving over said ribs in sliding contact therewith.

12. A machine according to claim 9 wherein said support means comprises a plurality of rollers spaced from each other and arranged parallel to the axis of rotation of the cylinder mold, said liquid-impervious belt moving over said rollers while the rollers are rotating.

13. A machine according to claim 9 wherein said support means is mounted in a stand pivotably arranged about a horizontal axis to move the end of the support means which faces away from the breast roll in relation to the axis of rotation of the cylinder mold in order to position the upper limitation plane of the support means with and in contact with the liquid-impervious belt in dependence of the diameter of the cylinder mold.

14. A machine according to claim 12 wherein said stand is supported by two parallel support arms, said arms are provided with bearing means to permit pivotable journalling of the stand about the axis of rotation of the breast roll, and said arms are also provided with adjusting means for controlling the movement of the stand and the support means.

15. A machine according to claim 2 wherein the vat is arranged straight above the cylinder mold and substantailly entirely above the horizontal central plane of the cylinder mold, so that the surface of the stock in the vat will be situated above and at a distance from the upper level of the cylinder mold and wherein the liquid-impervious belt extends substantially vertically between the breast roll and the cylinder mold.

16. A machine according to claim 15 wherein the vat is entirely sealed so that a pressure above atmospheric will be exerted on the surface of the stock in the vat in order to increase drainage of the water through the cylinder mold.

17. A machine according to claim 16 wherein the headbox is a multi-layer headbox.

18. A machine according to claim 15 wherein a stock channel is provided in the headbox and a pipe for supplying a security thread to be enclosed in the web is arranged to extend into said stock channel, and said pipe being vertically movable to allow adjustment of the security thread to the correct position at the forming zone.

19. A machine according to claim 18 wherein the pipe terminates in a pipe bend facing into the vat, and the pipe is laterally pivotable to allow said pipe bend to be pivoted laterally, thereby altering the position of the security thread across the web.

20. A machine according to claim 1 wherein said cylinder mold includes means for effecting water marks in the web.

* * * * *

UNITED STATES PATENT AND TRADEMARK OFFICE

CERTIFICATE OF CORRECTION

PATENT NO. : 4,784,725

DATED : November 15, 1988

INVENTOR(S) : Erik G. Stenberg

It is certified that error appears in the above-identified patent and that said Letters Patent is hereby corrected as shown below:

Column 1, line 12, "know" should be -- known --.

Column 1, line 61, after "liquid-impervious", please insert -- belt running in a loop inside the vat and surrounding a part of --.

Column 8, line 47, "thereby" should be -- thereby --.

Column 9, line 6, "rotatabe" should be -- rotatable --.

Column 10, lines 36 and 37, "substantailly" should be -- substantially --.

Signed and Sealed this

Twenty-second Day of August, 1989

*Attest:*

DONALD J. QUIGG

*Attesting Officer*

*Commissioner of Patents and Trademarks*